US010336506B2

(12) United States Patent
Hoekstra et al.

(10) Patent No.: US 10,336,506 B2
(45) Date of Patent: Jul. 2, 2019

(54) LID MADE OF FIBROUS MATERIAL

(75) Inventors: Aad Hoekstra, Zutphen (NL); RaiMangat Sharma, Tyristrand (NO); Stephen Knipe, Hampshire (GB)

(73) Assignee: HUHTAMAKI OYJ, Espoo (FI)

( * ) Notice: Subject to any disclaimer, the term of this patent is extended or adjusted under 35 U.S.C. 154(b) by 486 days.

(21) Appl. No.: 13/990,323

(22) PCT Filed: Nov. 29, 2011

(86) PCT No.: PCT/EP2011/071298

§ 371 (c)(1),
(2), (4) Date: May 29, 2013

(87) PCT Pub. No.: WO2012/072638

PCT Pub. Date: Jun. 7, 2012

(65) Prior Publication Data

US 2013/0248481 A1 Sep. 26, 2013

(30) Foreign Application Priority Data

Nov. 30, 2010 (DE) ..... 10 2010 062 194

(51) Int. Cl.
*B65D 41/18* (2006.01)
*B65D 43/02* (2006.01)
(Continued)

(52) U.S. Cl.
CPC ..... *B65D 41/185* (2013.01); *B65D 43/0212* (2013.01); *B65D 43/065* (2013.01);
(Continued)

(58) Field of Classification Search
CPC ..... B65D 2543/00046; B65D 2543/00092; B65D 2543/00537; B65D 43/0212;
(Continued)

(56) References Cited

U.S. PATENT DOCUMENTS 1,351,438 A * 8/1920 Pease et al. ..... 215/326
1,706,007 A * 3/1929 Van Alstyne et al. ..... 229/5.6
(Continued)

FOREIGN PATENT DOCUMENTS

CA 2510407 A1 1/2007
JP 2007039093 A * 2/2007
(Continued)

*Primary Examiner* — Steven A. Reynolds
*Assistant Examiner* — Javier A Pagan
(74) *Attorney, Agent, or Firm* — Husch Blackwell LLP

(57) ABSTRACT

A lid consisting of fibrous material, in particular of fibrous material containing cellulose fibers, for at least partly covering an opening of a container is provided. The lid comprises a domed portion which is configured to at least partly cover the container opening and an attachment portion which externally surrounds the domed portion at least in portions. The lid attachment portion is configured to attach the lid to a counter attachment portion in the region of the opening of the container, preferably on an opening edge delimiting the container opening of the container. The lid can be formed at least in portions, preferably completely, from a uniform material with respect to its constituents, and the lid can have material characteristics which differ in different regions within a portion of a uniform material composition.

18 Claims, 3 Drawing Sheets

(51) Int. Cl.
*B65D 65/46* (2006.01)
*B65D 43/06* (2006.01)

(52) U.S. Cl.
CPC .. *B65D 65/466* (2013.01); *B65D 2543/00046* (2013.01); *B65D 2543/00092* (2013.01); *B65D 2543/00268* (2013.01); *B65D 2543/00351* (2013.01); *B65D 2543/00527* (2013.01); *B65D 2543/00537* (2013.01); *B65D 2543/00731* (2013.01); *B65D 2543/00805* (2013.01)

(58) Field of Classification Search
CPC ..... B65D 2543/00351; B65D 81/3874; B65D 2543/00268; B65D 65/42; B65D 1/0207; B65D 2543/00314
USPC ..... 162/123, 125–132, 188, 203, 218–230, 162/396, 416; 220/4.21, 4.24, 712–718; 229/125.19–125.32, 125.36, 404, 407, 229/900; 428/34.2, 36.4, 65.9, 66.3, 84, 428/153, 154, 211.1, 212, 217, 218, 428/292.7, 311.11, 326, 340–342; D9/447
See application file for complete search history.

(56) References Cited

U.S. PATENT DOCUMENTS 1,748,865 A * 2/1930 Chaplin ..... 220/574
2,233,489 A * 3/1941 Reifsnyder ..... 229/5.5
2,377,864 A * 6/1945 Chaplin ..... 162/219
2,493,086 A * 1/1950 Reifsnyder ..... 229/125.25
2,501,849 A * 3/1950 Krebs ..... 215/261
2,700,186 A * 1/1955 Stover ..... 264/268
2,721,686 A * 10/1955 Reifsnyder et al. ..... 229/5.5
2,879,935 A * 3/1959 Carter ..... 229/404
3,083,861 A * 4/1963 Amberg et al. ..... 220/371
3,235,164 A * 2/1966 Anderson et al. ..... 229/125.17
3,283,942 A * 11/1966 Collie ..... 220/789
3,739,976 A * 6/1973 MacDaniel ..... 220/780
RE28,658 E * 12/1975 MacDaniel ..... 229/403
3,927,820 A * 12/1975 Wagner et al. ..... 220/796
4,121,728 A * 10/1978 Tagalakis et al. ..... 215/260
4,525,396 A * 6/1985 Takasa et al. ..... 428/34.2
4,589,569 A * 5/1986 Clements ..... 220/380
4,606,496 A * 8/1986 Marx et al. ..... 229/406
4,609,140 A * 9/1986 Van Handel et al. ..... 229/406
4,621,513 A * 11/1986 Bradford, Jr. ..... 72/334
D287,919 S * 1/1987 Clements ..... D7/392.1
4,810,430 A * 3/1989 DeLuca ..... 264/3.3
5,088,640 A * 2/1992 Littlejohn ..... 229/406
5,356,518 A * 10/1994 Kelley et al. ..... 162/224
5,385,255 A * 1/1995 Varano et al. ..... 229/404
5,393,582 A * 2/1995 Wang et al. ..... 428/34.2
5,398,843 A * 3/1995 Warden et al. ..... 220/711
5,509,568 A * 4/1996 Warden et al. ..... 220/711
5,543,186 A * 8/1996 Andersen et al. ..... 428/34.4
5,647,501 A * 7/1997 Helms ..... 220/780
5,669,550 A * 9/1997 Klemme et al. ..... 229/4.5
5,725,916 A * 3/1998 Ishii et al. ..... 428/34.2
5,738,921 A * 4/1998 Andersen et al. ..... 428/36.4
5,766,709 A * 6/1998 Geddes et al. ..... 428/35.7
D417,845 S * 12/1999 Sadlier et al. ..... D9/447
6,042,000 A * 3/2000 Kawamoto ..... 229/406
6,138,899 A * 10/2000 Grabher ..... 229/5.5
6,210,147 B1 * 4/2001 Mori et al. ..... 425/384
6,224,954 B1 * 5/2001 Mitchell et al. ..... 428/34.2
6,268,028 B1 * 7/2001 Buchanan et al. ..... 428/34.2
6,309,717 B1 * 10/2001 Qiu et al. ..... 428/34.2
6,454,906 B1 * 9/2002 Nonomura et al. ..... 162/220
6,461,480 B1 * 10/2002 Otakura et al. ..... 162/220
6,468,398 B1 * 10/2002 Kumamoto et al. ..... 162/220
6,488,170 B1 * 12/2002 Johnson ..... 220/254.2
6,547,931 B1 * 4/2003 Kumamoto et al. ..... 162/219
6,576,089 B1 * 6/2003 Sato et al. ..... 162/227
6,702,145 B2 * 3/2004 Malcolm ..... 220/713
6,729,534 B2 * 5/2004 Van Handel ..... 229/403
6,752,910 B2 * 6/2004 Sato et al. ..... 162/396
6,811,843 B2 * 11/2004 DeBraal et al. ..... 428/34.2
6,846,529 B2 * 1/2005 Mohan et al. ..... 428/34.2
6,919,111 B2 * 7/2005 Swoboda et al. ..... 428/34.2
D516,424 S * 3/2006 Schweigert et al. ..... D9/447
7,048,975 B1 * 5/2006 Tojo et al. ..... 428/34.3
7,074,466 B2 * 7/2006 DeBraal et al. ..... 428/34.2
7,077,933 B2 * 7/2006 Otani et al. ..... 162/218
7,111,749 B1 * 9/2006 Akers ..... 220/359.2
7,131,551 B2 * 11/2006 Smith ..... 220/254.1
7,134,566 B2 * 11/2006 Smith et al. ..... 220/254.1
D537,717 S * 3/2007 Notarianni ..... D9/449
7,185,781 B2 * 3/2007 Pitts ..... 220/367.1
7,191,911 B2 * 3/2007 O'Neill ..... 220/254.1
D591,595 S * 5/2009 Tedford, Jr. ..... D9/447
7,591,393 B2 * 9/2009 Crudgington, Jr. ..... 220/713
7,757,885 B2 * 7/2010 Goeking et al. ..... 220/713
7,845,509 B2 * 12/2010 Burchard ..... 220/254.1
D635,855 S * 4/2011 Smith et al. ..... D9/447
7,992,741 B2 * 8/2011 Hundley et al. ..... 220/254.5
8,056,752 B2 * 11/2011 Carnevali ..... 220/372
8,251,242 B2 * 8/2012 Vovan ..... B65D 43/0254 220/266
8,283,008 B2 * 10/2012 Lutzig et al. ..... 428/35.7
D727,729 S * 4/2015 Shi ..... D9/447
2001/0040016 A1 * 11/2001 Kumamoto et al. ..... 162/218
2002/0038803 A1 * 4/2002 Malcolm ..... 220/713
2002/0119221 A1 * 8/2002 Matsukura et al. ..... 426/115
2002/0172818 A1 * 11/2002 DeBraal et al. ..... 428/318.4
2002/0189776 A1 * 12/2002 Kumamoto et al. ..... 162/218
2003/0029591 A1 * 2/2003 Otani et al. ..... 162/218
2003/0102283 A1 * 6/2003 Fox ..... 215/364
2003/0111201 A1 * 6/2003 Sato et al. ..... 162/382
2003/0121635 A1 * 7/2003 Kumamoto et al. ..... 162/218
2003/0152724 A1 * 8/2003 Swoboda et al. ..... 428/34.2
2004/0011803 A1 * 1/2004 D'Amato ..... 220/780
2004/0076777 A1 * 4/2004 Bayss et al. ..... 428/34.1
2004/0200849 A1 * 10/2004 Goeking et al. ..... 220/713
2004/0209023 A1 * 10/2004 Swoboda et al. ..... 428/34.2
2004/0232154 A1 * 11/2004 Smith et al. ..... 220/713
2005/0112305 A1 * 5/2005 Swoboda et al. ..... 428/34.2
2005/0173434 A1 * 8/2005 O'Neal ..... 220/212
2006/0000832 A1 * 1/2006 Smith et al. ..... 220/253
2006/0037962 A1 * 2/2006 Kim ..... 220/713
2006/0071008 A1 * 4/2006 Sadlier ..... 220/713
2006/0180028 A1 * 8/2006 Burchard ..... 99/275
2006/0213908 A1 * 9/2006 Clarke et al. ..... 220/254.3
2006/0213916 A1 * 9/2006 Brown et al. ..... 220/780
2006/0226148 A1 * 10/2006 Hundley et al. ..... 220/254.3
2006/0243734 A1 * 11/2006 Tedford, Jr. ..... 220/780
2006/0255037 A1 * 11/2006 Hollis et al. ..... 220/254.3
2006/0255038 A1 * 11/2006 Hollis et al. ..... 220/254.3
2007/0012698 A1 * 1/2007 Durdon et al. ..... 220/253
2007/0029322 A1 * 2/2007 Durdon et al. ..... 220/254.4
2007/0045316 A1 * 3/2007 Arnljots ..... 220/254.5
2007/0075079 A1 * 4/2007 Stokes ..... 220/212
2007/0075081 A1 * 4/2007 Stokes ..... 220/212
2007/0095832 A1 * 5/2007 Hollis et al. ..... 220/254.5
2007/0114236 A1 * 5/2007 Shiffer et al. ..... 220/782
2007/0131691 A1 * 6/2007 Evans ..... 220/254.5
2008/0011762 A1 * 1/2008 Boone ..... B65D 43/0212 220/713
2008/0035652 A1 * 2/2008 Lusareta ..... 220/713
2008/0047966 A1 * 2/2008 Carson ..... 220/713
2008/0230541 A1 * 9/2008 Bayss et al. ..... 220/200
2009/0065518 A1 * 3/2009 Carnevali ..... 220/711
2010/0012657 A1 * 1/2010 Levey ..... B65D 43/0212 220/379
2010/0044267 A1 * 2/2010 Tolibas-Spurlock et al. ..... 206/524.7
2010/0096395 A1 * 4/2010 Miller ..... 220/711
2010/0176130 A1 * 7/2010 Kim ..... 220/254.1
2010/0294448 A1 * 11/2010 Pierce et al. ..... 162/224
2011/0011549 A1 * 1/2011 Pierce et al. ..... 162/227
2011/0139800 A1 * 6/2011 Urban ..... B65D 43/0212 220/713
2011/0233208 A1 * 9/2011 Kim ..... 220/254.1

(56) References Cited

U.S. PATENT DOCUMENTS

| | | | | |
|---|---|---|---|---|
| 2011/0233209 | A1* | 9/2011 | Tu | 220/254.1 |
| 2011/0240666 | A1* | 10/2011 | Mihaylov | 220/796 |
| 2011/0278300 | A1* | 11/2011 | Sharma et al. | 220/315 |

FOREIGN PATENT DOCUMENTS

| | | | |
|---|---|---|---|
| WO | 2010027365 | A1 | 3/2010 |
| WO | 2010064899 | A1 | 6/2010 |
| WO | WO 2010064899 | A1 * | 6/2010 |

* cited by examiner

LID MADE OF FIBROUS MATERIAL

CROSS-REFERENCE TO RELATED APPLICATIONS

None.

FIELD OF THE INVENTION AND BACKGROUND

The present invention relates to a lid made of fibrous material which is used for at least partly covering a container opening of a container, for example a mug or a cup for take-away beverages. Lids of this type are used to protect the contents of the container from being accidentally spilt, or also to protect the contents from cooling down too fast.

SUMMARY OF THE INVENTION

The lid which is the subject of the present invention is formed at least in portions, preferably completely from a fibrous material, in particular from a fibrous material containing cellulose fibres. For financial reasons, a fibrous material of this type is preferably paper or cardboard.

The lid which is the subject of the invention has on the one hand a domed portion which is configured to at least partly cover the above-mentioned opening of the container when the lid is positioned on the container. The lid also comprises an attachment portion which is configured to attach the lid to a counter attachment portion in the region of the container opening. An opening edge of the container which delimits the container opening and which is usually configured as an peripheral bead for the mouth and thus has the stability required for the attachment of the lid has proved to be particularly suitable for attaching the lid. The attachment portion surrounds the domed portion at least in portions, preferably completely, on the outside so that the domed portion is thus positioned in a region of the lid which is enclosed by the attachment portion.

To simplify the production process, the lid is formed at least in portions, i.e. at least in the region formed from fibrous material, of a material which is of a uniform composition with respect to its constituents. More preferably, the entire lid is formed of a material which is substantially of a uniform composition with respect to its constituents.

A lid of this type is known, for example, from WO 2010/064899 A1.

The object of the present invention is to further improve the lid known from the prior art.

This object is achieved according to the invention in the case of a generic lid in that the lid has different material characteristics in different regions within a portion of a uniform material composition.

As a result of these different material characteristics within a portion of a uniform material composition, it is possible for a lid to be substantially or even completely formed from a material with a uniform composition and yet this lid can be configured with different material characteristics in different portions according to requirements.

For example, the lid can have a smaller density in a region of the attachment portion than in a region of the domed portion.

In the case of fibrous material, the density of the material is related to the number of fibres per unit of volume, such that more fibres per unit of volume are present in regions with a greater density than in regions of a lesser density. Consequently, fibres in low density regions are more movable so that these regions have a greater inner damping than regions of a greater density. This is naturally apart from the lower weight due to the lower density.

Likewise, the lid can have a greater porosity in a region of the attachment portion than in a region of the domed portion. This region of a greater porosity allows liquid to be absorbed in the fibre interspaces formed thus. Thus, a fibrous material region of a greater porosity can absorb a greater amount of liquid than a fibrous material region of the same mass having a lower porosity.

It is thus possible to provide on lids for cups which are frequently used for holding liquids, an absorbent region in the attachment portion which absorbs liquid from the cup and keeps it in the lid before this liquid undesirably spills from the cup and falls, for example, onto the hand or clothing of the person who is using the cup at the time.

It can be further provided for the lid to have a greater surface roughness in a region of the attachment portion than in a region of the domed portion. This can ensure that the attachment portion which is usually gripped by the person using the cup to attach the lid to the cup to transmit the force required for attachment onto the lid. The greater surface roughness reduces the risk of the lid slipping through the user's hand. Thus the lid remains very securely in the user's hand without attaching additional elements and does not fall onto the ground, for example, which is very undesirable where foodstuffs are concerned. On the side of the attachment portion facing the container, the greater surface roughness in the attachment portion can increase the friction between lid and container and thus the retention of the lid on the container is improved.

In order not to adversely affect the consumer acceptance of the lid, attempts are made to increase in certain regions the smoothness of the surface primarily, preferably exclusively on the outer side remote from the container. For this reason, the surface roughness of the lid on its outer side directed away from the container during intended use is also lower than on its opposite inner side.

It can also be provided for the lid to have a lower flexural strength in a region of the attachment portion than in a region of the domed portion.

As a result of the reduced flexural strength in the attachment portion, the force required for attaching the lid to a container and for removing said lid from the container is reduced so that relatively weak and unsteady people are also able to attach the lid easily and securely on the container provided and to remove the lid therefrom.

On the other hand, due to the lower flexural resilience in the region of the attachment portion, the domed portion is mechanically uncoupled from the attachment portion to an appreciable extent so that jolts acting intentionally or unintentionally on the domed portion have less of an effect than before on the attachment portion. Consequently, the fit of the lid on the associated container is improved and the risk of the contents of the container spilling, which is undesirable, is reduced.

To provide the container covered by the presently discussed lid with the largest possible volume, it can be provided in a manner known per se that the domed portion has a substantially central covering region and an outer wall region which externally surrounds said central covering region.

Due to its shape, the lid can be described in a particularly suitable manner in a polar coordinate system, the lid extending around a lid axis and along said axis. The distance of a lid portion from the lid axis which is as central as possible is the radial distance of this region from the lid axis. If the lid is not configured rotationally symmetrically based on the lid axis, the angle at which the radius ray relative to a lid portion is observed is also significant.

Lids of this type often have a quasi-rotationally symmetrical shape based on the lid axis, i.e. some regions, for example the attachment portion, are rotationally symmetrical while the domed portion often exhibits slight deviations from the rotational symmetry. The covering region is often a substantially planar region which can be produced easily and in a uniform manner. It is preferably aligned orthogonally to the lid axis or inclined thereto.

The outer wall portion can preferably have a simple to produce, conical or frustoconical shape due to the covering region. Therefore, the outer wall region usually has a greater axial extension component than radial extension component, whereas the covering region usually has a greater radial extension component than axial extension component.

For a domed portion configured thus, it can be provided that the lid has in the covering region a greater density and/or a lower surface roughness and/or a greater flexural strength and/or a lower porosity than in the outer wall region.

Due to its lower porosity per unit of volume, the covering region can absorb less liquid, thus does not soften so much when wetted and substantially retains its stability.

By virtue of a lower density of the outer wall region compared with that of the covering region, weight can be reduced on the outer wall region and the inner damping with respect to impacts on said outer wall region can be increased. As previously explained in detail, the outer wall region can store in itself more liquid per unit of volume due to its greater porosity compared with lower-porosity regions and thus, if the container is accidently tipped over or accidentally moved too vigorously, it can significantly reduce the amount of liquid issuing therefrom.

Due to its preferably conical or frustoconical shape, respectively, the outer wall region is substantially more suitable for gripping when handling the lid than the covering portion which does not encourage gripping due to its position and shape. For this reason, it can be advantageous to provide the outer wall region, which is actually gripped, with a greater surface roughness than the covering region and to thus increase the grip sureness thereof.

Furthermore, the outer wall region can be provided with a further increased grip sureness due to a lower flexural strength than that of the covering region. Consequently, this means that it is possible to deform the outer wall region with lower forces during gripping so that the gripping fingers can press and mould at least a little way into the outer wall region.

According to a development of the present invention, in a specific constructive configuration, the attachment portion can have a supporting region which is configured to support the lid on the counter attachment portion, described above, of the container. This support is preferably a contact support in which at least part of the supporting region is in contacting engagement with the counter attachment portion of the container. Consequently, the lid can be arranged in an extremely stable manner on the counter attachment portion of the container.

Furthermore, the attachment portion can have an undercut region which has a smaller clearance than the supporting region and thus is suitable for engaging behind the counter attachment portion of the container. When the lid or, more precisely, the attachment portion is arranged on the associated container, a release safety means of the lid is provided, preferably in the form of a releasable lock, in addition to the stable arrangement of the lid provided by the supporting region on the container by the undercut region. As a result, a correct attachment of the lid on the container can be felt by the user.

Applying the polar coordinate system mentioned above, the undercut region has at least one region, the distance of which from the lid axis is shorter than a region of the supporting region positioned in the same angular direction.

If the undercut region has a lower density than the supporting region, the smaller number of fibres per unit of volume in the undercut region provides a greater mobility and deformability, but also a greater inner damping of the material than in the supporting region which diverts into the container forces introduced into the lid during operation and is thus preferably of a more stable configuration. This facilitates the intended arrangement of the undercut region on the associated container with the formation of the previously mentioned preferred releasable lock as the release safety means.

As a result of a greater surface roughness, a greater grip sureness of the lid is also achieved in the undercut region, which is particularly advantageous when, during attachment of the lid to the container, the entire undercut region has not reached its intended position in which it engages behind the counter attachment portion of the container.

Due to a lower flexural strength in the undercut region than in the supporting region, the force required for attaching and, if desired, locking the lid on the container can advantageously be reduced, without the attachment sureness of the lid on the container suffering as a result.

The greater porosity ensures an increased absorptivity, i.e. an increased liquid absorbing capacity per unit of volume, as previously discussed.

The supporting region and the covering region preferably extend parallel or at least mainly in the same direction. As mentioned above, this direction is preferably orthogonal to the lid axis or is slightly inclined relative thereto. It is advantageous in terms of production if the density and/or the surface roughness and/or the flexural strength and/or the porosity of the lid in the supporting region differ by not more than 25%, preferably by not more than 15% from the same variable in each case in the covering region, based on the greater value of the variable concerned. Accordingly, the lid can also have a greater density and/or a lower surface roughness and/or a greater flexural strength and/or a lower porosity in the supporting region than in the outer wall region.

Openings are preferably provided in the lid, more preferably in the covering region, for example to allow liquid to be removed from the container even when the lid is attached. Furthermore, openings can be provided to introduce stirring devices through the lid into the interior of the container and to operate them. Openings of this type can be formed by punching or cutting procedures in regions of a greater material thickness with more accuracy than in regions of a lower density.

The container contents, in particular liquid, can also undesirably issue from the container provided with a lid through openings of this type. The advantage of an increased absorptivity of the lid at least in specific regions of increased porosity to prevent soiling of the body and clothing of the user or even to prevent the user from being scalded has already been discussed.

In spite of this absorptivity, it is possible for liquid to issue out of the mentioned openings in the lid and not to be absorbed, for example because absorbent regions are already saturated with liquid. To prevent the user or his clothes from being soiled or to prevent the user from being scalded, it is advantageous if the lid has, as a transition region between domed portion and attachment portion, in particular outer wall portion and supporting region, a concavely curved grooved region when observing the outer side of the lid which is directed away from the container when the lid is attached as intended to the container, which concavely curved grooved region forms a recess with respect to the domed portion and the attachment portion, in particular with respect to the outer wall region and the supporting region.

Thus, when a lid is observed which is attached to a vertically upright container, a base of the grooved region has a greater axial distance from the covering region than the supporting region.

For the reasons which have already been mentioned: low weight, absorptivity, high material mobility and deformability, the grooved region advantageously has a lower density and/or a higher porosity than the adjacent supporting region. This also applies more preferably in respect of the density of the outer wall region which is also adjacent. Thus it is possible for liquid which has been spilt to collect in the grooved region; there it can be effectively sucked up and even if the liquid absorbing capacity of the grooved region is saturated, liquid is retained relatively safely in the grooved region.

Due to a greater surface roughness in the grooved region, it is possible, at least where relatively high-viscosity liquids are concerned, to achieve a specific immobilisation of said liquids when they issue undesirably from the cup and pass into the grooved region. This measure also protects the user from being soiled by the liquid which has been undesirably spilt.

Stacked lids can be at least partly immobilised by the body friction which may thus be increased on the surface roughness, which is preferably only increased on the inside facing the container during use, of the grooved region.

As a result of the lower flexural strength, the grooved region which in any case ensures a relative mobility between domed portion and attachment portion due to its preferably U-shaped or V-shaped cross section in a cross-sectional plane containing the lid axis, can mechanically uncouple the domed portion and attachment portion even more, so that jolts exerted on the dome portion are not propagated or are hardly propagated as far as the attachment portion or the counter attachment portion directly engaged with said attachment portion.

The grooved region and the undercut region preferably have the lowest density and/or the highest surface roughness and/or the lowest flexural strength and/or the highest porosity in the entire lid.

Furthermore, it is advantageous if the undercut region and the grooved region, which are both to have a resilient damping characteristic, have substantially the same or similar values of density and/or surface roughness and/or flexural strength and/or porosity. In this respect, it is particularly preferred for the density and/or surface roughness and/or flexural strength and/or porosity of the lid in the grooved region to differ by not more than 25%, preferably by not more than 15% from the same variable in each case in the undercut region based on the greater value of the variable concerned.

When the lid is attached to the associated container, the lid often forms an outer edge of the lid-container combination, because the lid is often put radially over the outside of the counter attachment portion of the container.

Using the lid to cover from above at least in portions the user's hand which is grasping the container and thus to be able to protect it, it is advantageous for the lid to have a peripheral region which externally, i.e. radially externally surrounds the attachment portion, in particular the undercut region thereof. The peripheral region preferably extends in the radial direction away from the regions of the lid which are directly adjacent in the radial direction in order to arrange material between the outermost edge of the lid and the functional portions thereof which are located radially further inwards.

Since the undercut region which preferably directly adjoins the peripheral region has a low flexural resilience, and preferably together with the grooved region even has the lowest flexural resilience of the lid regions which have been described, the peripheral region can have a greater flexural strength than the undercut region and/or the grooved region, so that the peripheral region which is located radially furthest outwards of all the described lid regions can provide the lid with an increased stability. A greater density of the peripheral region, compared with that of the undercut region and/or of the grooved region also contributes overall to the consistency in the shape of the lid. In order to be able to ensure this contribution to the stability over a relatively long operating period, it is advantageous for this peripheral region to have a lower porosity than the adjacent undercut region so that when said peripheral region comes into contact with liquid, it absorbs less liquid and thus softens less. Furthermore, the lowest possible surface roughness is preferred for the peripheral region so that this peripheral region can easily be provided with a printing, for example to provide information thereon for the respective user.

The ratio of the above variables of the peripheral region to those of the undercut region and/or of the grooved region preferably also applies in the ratio of the peripheral region to the outer wall region.

Since the peripheral region preferably extends at least in portions parallel to the covering region and/or to the supporting region or at least extends substantially in the same direction as the covering region and the supporting region, it is particularly preferred for the density and/or surface roughness and/or flexural strength and/or porosity of the lid in the peripheral region to differ by not more than 25%, preferably by not more than 15% from the same variable in each case in the undercut region and/or in the covering region based on the greater value of the variable concerned. Thus, it is possible to produce the covering region and/or the supporting region and the peripheral region substantially by uniform process steps.

During the production of the lid in the compression moulding process, the above-mentioned regions having different material characteristics can be produced using a plurality of moulding steps and different moulding pressures in different regions. Furthermore, the compression moulding duration of different moulding steps can be selected to differ in order to reinforce different material characteristics. Different regions can also be subjected to moulding pressures for different periods of time in individual compression moulding steps.

The flexurally stronger, smoother (less rough) and denser regions of the lid, such as the covering region, supporting region and peripheral region, which are discussed above, are usually produced by higher moulding pressures which prevail in individual compression moulding steps.

DESCRIPTION OF THE SEVERAL VIEWS OF THE DRAWING

In the following, the present invention will be described in more detail with reference to the accompanying figures. These figures illustrate a preferred embodiment of the present invention.

DETAILED DESCRIPTION OF THE INVENTION

Figure 1:
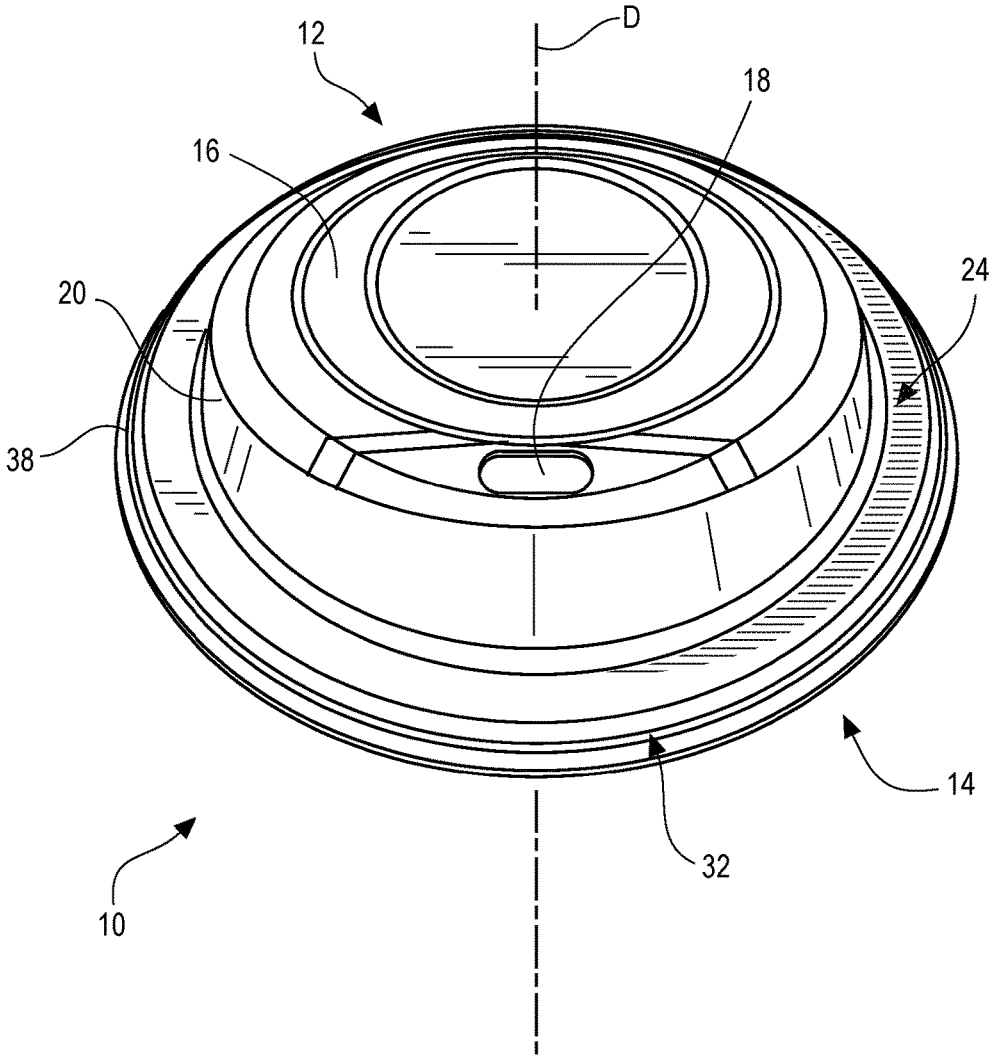
FIG. 1 is a perspective view of a lid according to the invention.

In FIG. 1, a lid which is preferably formed completely from material containing cellulose fibres is generally denoted by reference numeral 10. To facilitate its handling, the lid 10 can be configured to be approximately rotationally symmetrical with respect to a lid axis D which passes through the centre of the lid 10.

The lid 10 has a domed portion 12 which is located radially relatively close to the lid axis D and also has an attachment portion 14 which preferably radially surrounds the outside of the domed portion 12 and preferably completely surrounds the domed portion 12 in order to provide the most reliable attachment possible of the lid to a container.

The domed portion 12 has a covering region 16 which is preferably located radially relatively close to the lid axis D and which, in the illustrated example, extends substantially orthogonally or at a slight incline to the lid axis D but, in a deviation to this, can be configured to be concavely or convexly curved at least in portions.

In the covering region 16, an introduction opening and/or removal opening 18 can be provided which allows the handling and/or removal of contents of a container covered by the lid 10.

The domed portion 10 can have beyond the covering region 16 an outer wall region 20 which can have a roughly conical shape to provide the container, to which the lid 10 is attached, with a protected volume beyond the attachment portion 14 in the axial direction of the lid axis D, for example in the case of foaming beverages such as cappuccino or beer, to provide space in the covered container for a froth which may be present.

While in the illustrated example the covering region has a mainly radial extension, but it only has a small axial extension in the region of its radial extension, the outer wall region 20 has a substantially smaller radial extension than axial extension in the region of its axial extension.

In order to desirably reinforce the domed portion 12 and thus the lid 10, the entire outer wall region 20 can have a reinforcing shape, for example in the form of bulges (not shown) which are distributed along the periphery and taper in the axial direction.

Figure 3:
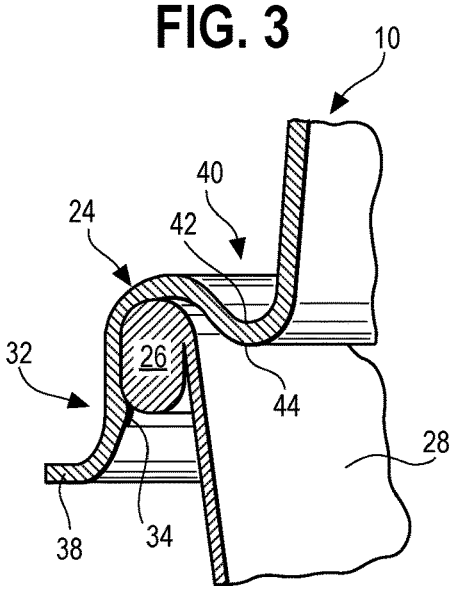
FIG. 3 shows a detail enlargement of the cross-sectional view of the attachment portion of the lid of FIGS. 1 and 2 in a state attached to a container.
Figure 4:
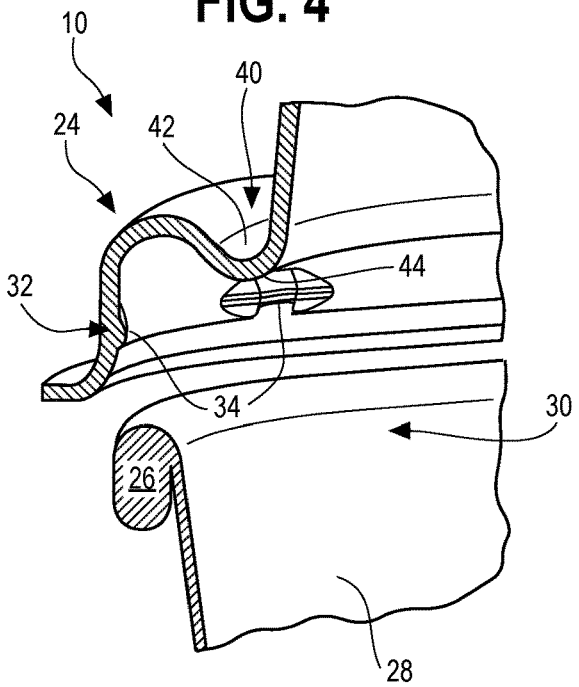
FIG. 4 is substantially the view of FIG. 3 with the lid released from the container.

The attachment region 14 which is also shown on an enlarged scale in FIGS. 3 and 4 can have a supporting region 24 which is configured in particular to come into a contacting engagement with a counter attachment portion 26 of a container 28 on which the lid 10 is to be used. The counter attachment portion 26 used is preferably a peripheral bead for the mouth, which radially outwardly delimits a container opening 30, of the container 28. This has the advantage that with the peripheral bead for the mouth which is present anyway to provide a pleasant drinking sensation, a sufficiently stable counter attachment portion 26 is provided in a suitable area of the container 28 to be able to seat the lid 10 thereon in a stable manner.

For this reason, at least the attachment portion 14 of a lid is usually configured to be rotationally symmetrical and can be used to determine the lid axis D even if the domed portion 12 deviates from a rotational symmetry.

Due to its convexly curved, substantially toroidal outer shape, the peripheral bead for the mouth, as the counter attachment portion 26, allows the lid 10 to be secured by producing a releasable locking engagement of the lid 10, in particular of the attachment portion 14 thereof, with the counter attachment portion 26 of the container 28.

For this purpose, preferably configured in the attachment portion 14 is an undercut region 32 which has, at least in portions, a smaller clearance than the adjacent supporting region 24. In the illustrated example, this is due to accumulations 34 of material (see FIG. 4) which are advantageously provided on the inside of the lid 10 directed towards the lid axis D in the case of the attachment portion 14 which preferably radially surrounds the outside of the cup 28. Thus, a surface of the material accumulations 34 has a smaller radial distance from the lid axis D than a surface portion, located in the same direction from the lid axis D, of the supporting region 24.

As shown in FIGS. 3 and 4, the material accumulations 34 can be provided at a distance from one another in the circumferential direction or alternatively can be provided in a continuously encircling manner.

The attachment of the lid 10 to the cup 28 with a radial engagement over the counter attachment portion 26 on the outside is clearly preferred since, with this type of attachment, the container wall 36 which possibly emanates from the counter attachment portion 26, does not disturb the securing of the lid 10 on the container 28.

When the lid 10 is attached to the cup which usually also extends along a cup axis, the cup axis and the lid axis D preferably run collinearly.

A radially outwardly directed peripheral portion 38 emanating from the undercut region 32 in the attachment portion 14 can be provided as a hand grip protection or also as an information carrier.

The regions with a mainly radial extension, such as the covering region 16, the supporting region 24 and/or the peripheral region 18, if present, preferably have the highest densities and/or the greatest flexural strengths and/or the lowest surface roughnesses and/or the lowest porosities of all the mentioned regions. This means that a particularly stable lid is produced which can be securely supported on the counter attachment portion 26 of the container 28 in particular due to the bending resistant configuration of the supporting region 24.

The peripheral region 38 which is also resistant to bending and which is located completely outside radially provides the lid 10 with a further dimensional stability.

However, the undercut region 32 and a grooved region 40 which is preferably positioned between the outer wall region 20 and the supporting region 24 and which will be described in more detail further below have the lowest density and/or the lowest flexural strength and/or the greatest surface roughness and/or the greatest porosity of all the regions mentioned above.

As a result of the low flexural strength of the undercut region 32, the force required for producing the releasable lock of the lid 10 on the container 28 can be reduced, which facilitates the attachment of the lid 10 to the container 28. This is particularly helpful in the majority of cases when the lid 10 is attached to a container 28 which has already been filled with liquid, because low locking forces help to prevent an accidental and undesirable tilting of the container 28 and thus an at least partial spillage of the contents thereof.

At the same time, a surface roughness which is particularly increased in the undercut region 26 can on the one hand improve the seat of the lid on the container 28 due to an increased friction and can also increase the grip security of the user handling the lid 10, which is particularly advantageous during the production of the releasable lock of the lid 10 on the counter attachment portion 36 of the container 28.

The low flexural strength of the grooved region 40 ensures an advantageous mechanical uncoupling of the domed portion 12 from the attachment portion 14, so that forces which may act on the domed portion 12, in particular jolt-like forces do not result in the lid 10 becoming detached from the container 28 and also are not transmitted in full strength onto the container 28, so that in this case as well, the risk of an undesirable jolt-induced tilting of the container 28 covered by the lid 10 is reduced.

Due to the low density of the grooved region 40 and thus due to the lower fibre content per unit of volume, the mobility of the individual fibres is increased compared to denser regions of the lid 10, which in particular gives the grooved region 40 an inner damping which makes it possible to dampen in a radially outwards direction impulses acting on the domed portion 12.

Furthermore, the regions of a lower density generally have, due to their lower fibre content per volume fraction, a higher porosity and thus a higher absorptivity compared to denser regions of the lid 10. If the container 28 provided with the lid 10 is tilted too far, these regions can thus absorb liquid in a capillary manner and store it in the volume of the lid 10 before this liquid undesirably spills out of the container 28 provided with the lid 10. The inversely proportional correlation between density and porosity does not have to exist, however, for example if sufficient pore-filling material is added to the lid material. Thus, the lid can be impregnated for example, which eliminates the porosity without compensating for the differences in density.

The outer wall region 20 preferably has for its density and/or its flexural strength and/or its surface roughness and/or its porosity, values which on the one hand lie between those for the covering region 16, supporting region 24 and peripheral region 38 and on the other hand those for the undercut region 32 and grooved region 40. Thus, even in the outer wall region 20, the lid is absorbent at the same time as having an adequate dimensional stability, secure-grip surface roughness and deformability by the user gripping the lid.

For example, the fibre content in the covering region 16, supporting region 24 and peripheral region 38 can be approximately 60 fibres per $mm^3$.

Furthermore, the increased density in these regions, particularly in the covering region 16 and peripheral region 38 allows selective stamping procedures, for example for stamping the lid 10 out of a composite material or for providing the opening 18 in the covering region 16.

The fibre content in the outer wall region 20 can be, for example, 50 fibres per $mm^3$, while the fibre content in the grooved region 40 and in the undercut region 32 can be, for example 40 fibres per $mm^3$. These values are only approximate and depend on the length and diameter of the fibres used.

The grooved region 40 forms a recess 42 between the domed portion 12 and the attachment portion 14 such that a base 44 of the grooved region 40 has an axial distance A from the covering region 16 which is greater than the axial distance a of the portion region 24 from the same covering region 16.

If the covering region 16 is not rotationally symmetrical, the mentioned measurements are to be taken with identical angle coordinates.

Figure 2:
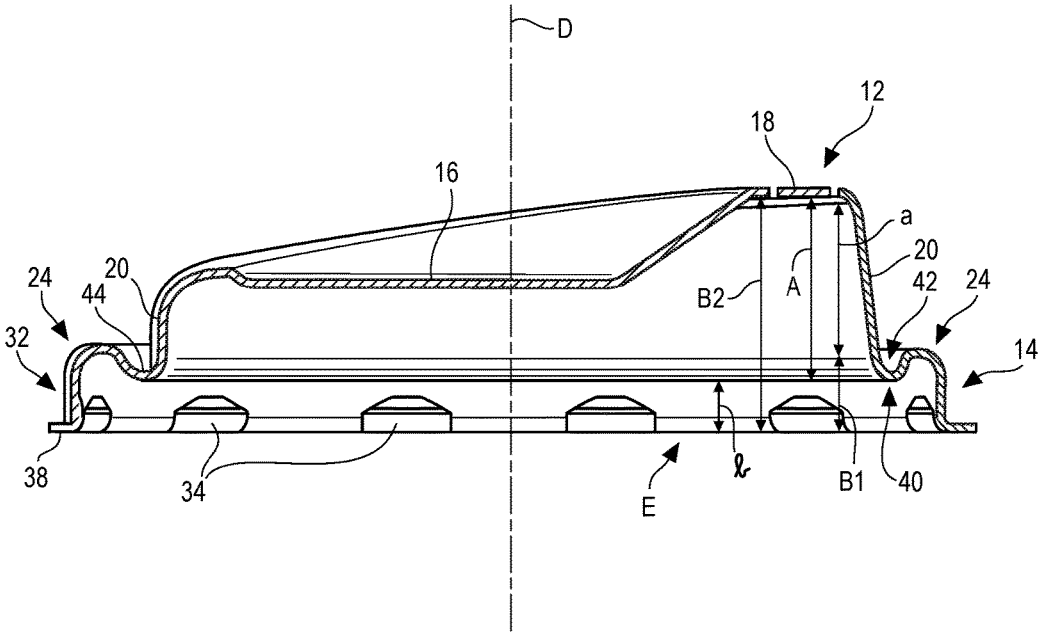
FIG. 2 is a cross-sectional view of the lid of FIG. 1 in a cross-sectional plane which contains the lid axis.

However, if a reference plane E is used which is substantially orthogonal to the lid axis D, preferably defined from the peripheral region 38 and which, in FIG. 2, is orthogonal to the plane of the drawing of this figure, then conversely it applies that the distance b of the base 44 from the reference plane is shorter than the distance B1 of the supporting region 24 from the same reference plane E and is likewise shorter than the axial distance B2 of the covering region 16 from the reference plane E.

Therefore, it is possible for liquid which issues undesirably, for example through the opening 18 in the covering region 16 due to the full container 28 being shaken too vigorously, to be collected in the grooved region 40 before it can spill over the hand and/or clothing of a person using the cup 28 with the lid 10. Thus, even if the grooved region 40, which is very absorbent compared to other regions of the lid 10 is saturated, i.e. soaked with liquid, it is still possible for liquid to be collected before it reaches the user of the covered container 28 in question.

The lid 10 illustrated in FIGS. 1 to 4 is produced from a material of a uniform composition with respect to the constituents. This means that even if there should be differences in density in the individual regions of the lid 10, these differences in density are formed in one and the same material.

The advantageous differences in the material characteristics of one and the same material in the lid 10 can be produced by an advantageous compression moulding process in which regions of a lid are subjected to the moulding pressure of a different force and/or with a different frequency and/or for a different duration.

Furthermore, following possible punching and/or cutting procedures, the lid 10 can be provided with an impregnation and/or a surface coating to prevent fibres from coming out of the material in the stamped or cut areas.

The invention claimed is:

1. A lid constructed from a fibrous material containing cellulose fibres and configured to at least partly cover an opening of a container, the lid comprising:

a domed portion which is configured to at least partly cover the opening of the container, and an attachment portion which at least partially externally surrounds the domed portion and is configured to attach the lid to a counter attachment portion of the container, wherein the counter attachment portion of the container is located around a perimeter edge of the opening of the container, wherein the lid includes a first lid part consisting of the fibrous material containing cellulose fibres and a second lid part consisting of the fibrous material containing cellulose fibres, wherein the first lid part has a first set of material characteristics comprising a first density, a first surface roughness, a first flexural strength, and a first porosity, wherein the second lid part has a second set of material characteristics comprising a second density, a second surface roughness, a second flexural strength, and a second porosity, wherein at least one material characteristic of the first set of material characteristics differs from a corresponding at least one material characteristic of the second set of material characteristics, wherein the first and the second densities are defined by the number of cellulose fibres per unit volume of the fibrous material containing cellulose fibres, wherein the first density is less than the second density, and wherein the first lid part comprises the attachment portion and the second lid part comprises the domed portion.

2. The lid according to claim 1, wherein the attachment portion comprises a supporting region extending generally horizontally away from the domed portion and an undercut region extending generally perpendicularly away from the supporting region, wherein the supporting region is configured for supporting the lid on the counter attachment portion of the container and at least partially contacting the counter attachment portion when the lid is in an attached state, and wherein the undercut region has a smaller clearance than the supporting region and is configured for at least partially engaging an exterior side of the counter attachment portion of the container when the lid is in the attached state.

3. The lid according to claim 2 wherein the domed portion comprises an outer peripheral wall extending generally upward from the supporting region of the attachment portion and a central covering wall extending generally across the outer peripheral wall, wherein the first lid part comprises the supporting region and the second lid part comprises the outer peripheral wall, wherein at least one of the first density is greater than the second density, the first surface roughness is less than the second surface roughness, the first flexural strength is greater than the second flexural strength, and the first porosity is greater than the second porosity.

4. The lid according to claim 1, wherein as a transition region between the domed portion and the attachment portion, the lid comprises a concavely curved grooved region when observing an outside of the lid which is directed away from the container when the lid is attached as intended to the container, wherein the concavely curved grooved region forms a recess between the domed portion and the attachment portion.

5. The lid according to claim 4, wherein the second density is greater than the first density by not more than 25%.

6. The lid according to claim 1, wherein the attachment portion comprises a supporting region extending generally horizontally away from the domed portion and an undercut region extending generally perpendicularly away from the supporting region, wherein the lid further comprises a peripheral region which externally surrounds the attachment portion and extends outwards away from the undercut region.

7. A lid constructed from a fibrous material containing cellulose fibres and configured to at least partly cover an opening of a container, the lid comprising:

a domed portion which is configured to at least partly cover the opening of the container, and an attachment portion which at least partially externally surrounds the domed portion and is configured to attach the lid to a counter attachment portion of the container, wherein the counter attachment portion of the container is located around a perimeter edge of the opening of the container, wherein the lid includes a first lid part consisting of the fibrous material containing cellulose fibres and a second lid part consisting of the fibrous material containing cellulose fibres, wherein the first lid part has a first set of material characteristics comprising a first density, a first surface roughness, a first flexural strength, and a first porosity, wherein the second lid part has a second set of material characteristics comprising a second density, a second surface roughness, a second flexural strength, and a second porosity, wherein at least one material characteristic of the first set of material characteristics differs from a corresponding at least one material characteristic of the second set of material characteristics, wherein the first flexural strength is less than the second flexural strength, and wherein the first lid part comprises the attachment portion and the second lid part comprises the domed portion.

8. The lid according to claim 7, wherein the attachment portion comprises a supporting region extending generally horizontally away from the domed portion and an undercut region extending generally perpendicularly away from the supporting region, wherein the supporting region is configured for supporting the lid on the counter attachment portion of the container and at least partially contacting the counter attachment portion when the lid is in an attached state, and wherein the undercut region has a smaller clearance than the supporting region and is configured for at least partially engaging an exterior side of the counter attachment portion of the container when the lid is in the attached state.

9. The lid according to claim 8, wherein the domed portion comprises an outer peripheral wall extending generally upward from the supporting region of the attachment portion and a central covering wall extending generally across the outer peripheral wall, wherein the first lid part comprises the supporting region and the second lid part comprises the outer peripheral wall, wherein at least one of the first density is greater than the second density, the first surface roughness is less than the second surface roughness, the first flexural strength is greater than the second flexural strength, and the first porosity is greater than the second porosity.

10. The lid according to claim 7, wherein as a transition region between the domed portion and the attachment portion, the lid comprises a concavely curved grooved region when observing an outside of the lid which is directed away from the container when the lid is attached as intended to the container, wherein the concavely curved grooved region forms a recess between the domed portion and the attachment portion.

11. The lid according to claim 10, wherein the second flexural strength is not greater than the first flexural strength by not more than 25%.

12. The lid according to claim 7, wherein the attachment portion comprises a supporting region extending generally horizontally away from the domed portion and an undercut region extending generally perpendicularly away from the supporting region, wherein the lid further comprises a peripheral region which externally surrounds the attachment portion and extends outwards away from the undercut region.

13. A lid constructed from a fibrous material containing cellulose fibres and configured to at least partly cover an opening of a container, the lid comprising:

a domed portion which is configured to at least partly cover the opening of the container, and an attachment portion which at least partially externally surrounds the domed portion and is configured to attach the lid to a counter attachment portion of the container, wherein the counter attachment portion of the container is located around a perimeter edge of the opening of the container, wherein the lid includes a first lid part consisting of the fibrous material containing cellulose fibres and a second lid part consisting of the fibrous material containing cellulose fibres, wherein the first lid part has a first set of material characteristics comprising a first density, a first surface roughness, a first flexural strength, and a first porosity, wherein the second lid part has a second set of material characteristics comprising a second density, a second surface roughness, a second flexural strength, and a second porosity, wherein at least one material characteristic of the first set of material characteristics differs from a corresponding at least one material characteristic of the second set of material characteristics, wherein the first porosity is greater than the second porosity, and wherein the first lid part comprises the attachment portion and the second lid part comprises the domed portion.

14. The lid according to claim 13, wherein the attachment portion comprises a supporting region extending generally horizontally away from the domed portion and an undercut region extending generally perpendicularly away from the supporting region, wherein the supporting region is configured for supporting the lid on the counter attachment portion of the container and at least partially contacting the counter attachment portion when the lid is in an attached state, and wherein the undercut region has a smaller clearance than the supporting region and is configured for at least partially engaging an exterior side of the counter attachment portion of the container when the lid is in the attached state.

15. The lid according to claim 14, wherein the domed portion comprises an outer peripheral wall extending generally upward from the supporting region of the attachment portion and a central covering wall extending generally across the outer peripheral wall, wherein the first lid part comprises the supporting region and the second lid part comprises the outer peripheral wall, wherein at least one of the first density is greater than the second density, the first surface roughness is less than the second surface roughness, the first flexural strength is greater than the second flexural strength, and the first porosity is greater than the second porosity.

16. The lid according to claim 13, wherein as a transition region between the domed portion and the attachment portion, the lid comprises a concavely curved grooved region when observing an outside of the lid which is directed away from the container when the lid is attached as intended to the container, wherein the concavely curved grooved region forms a recess between the domed portion and the attachment portion.

17. The lid according to claim 16, wherein and the first porosity is greater than the second porosity by not more than 25%.

18. The lid according to claim 15, wherein the attachment portion comprises a supporting region extending generally horizontally away from the domed portion and an undercut region extending generally perpendicularly away from the supporting region, wherein the lid further comprises a peripheral region which externally surrounds the attachment portion and extends outwards away from the undercut region.

* * * * *